US007434787B2

(12) United States Patent
Hjort

(10) Patent No.: US 7,434,787 B2
(45) Date of Patent: Oct. 14, 2008

(54) WINCH FOR RAISING AND LOWERING PERSONS

(75) Inventor: Mogens Hjort, Korsor (DK)

(73) Assignee: Ergolet A/S (DK)

( * ) Notice: Subject to any disclaimer, the term of this patent is extended or adjusted under 35 U.S.C. 154(b) by 295 days.

(21) Appl. No.: 10/547,615

(22) PCT Filed: Feb. 25, 2004

(86) PCT No.: PCT/EP2004/001841

§ 371 (c)(1),
(2), (4) Date: Aug. 29, 2005

(87) PCT Pub. No.: WO2004/076229

PCT Pub. Date: Sep. 10, 2004

(65) Prior Publication Data

US 2006/0253977 A1 Nov. 16, 2006

(30) Foreign Application Priority Data

Feb. 28, 2003 (EP) ..... 03004482

(51) Int. Cl.
*B66D 1/00* (2006.01)

(52) U.S. Cl. ..... 254/329; 254/334; 254/380; 5/85.1; 5/87.1; 104/89; 294/81.56; 294/81.54; 212/327

(58) Field of Classification Search ..... 254/329, 254/334, 342, 380; 5/81.1 R, 83.1, 85.1, 5/87.1, 89.1; 104/89; 294/82.11, 81.56, 294/81.61, 81.62, 81.51, 81.54, 82.1; 212/159, 212/327, 324

See application file for complete search history.

(56) References Cited

U.S. PATENT DOCUMENTS

| | | | | |
|---|---|---|---|---|
| 3,784,165 | A * | 1/1974 | Pruitt | 254/342 |
| 4,372,452 | A * | 2/1983 | McCord | 212/285 |
| 4,884,784 | A * | 12/1989 | Nix et al. | 254/362 |
| 5,295,664 | A * | 3/1994 | Kamper | 254/220 |
| 5,573,091 | A * | 11/1996 | Hung | 192/12 R |
| 6,035,465 | A * | 3/2000 | Rogozinski | 5/83.1 |
| 6,085,368 | A | 7/2000 | Robert et al. | 5/85.1 |
| 7,159,772 | B2 * | 1/2007 | Vande Berg | 235/385 |

* cited by examiner

*Primary Examiner*—Emmanuel M Marcelo
(74) *Attorney, Agent, or Firm*—K. David Crockett, Esq.; Crockett & Crockett

(57) ABSTRACT

The invention relates to a winch (6) for raising and lowering persons, of the type that comprises a housing with an attachment member (16), an electric motor (39) driving a reel (27), a lifting strap (7) connected to the reel for winding and unwinding the lifting strap whereby the lifting strap is guided through one of two openings (17,19) formed in the housing.

14 Claims, 11 Drawing Sheets

WINCH FOR RAISING AND LOWERING PERSONS

The present invention relates to a winch for raising and lowering persons, comprising a housing provided with a first attachment member, a first opening formed in the housing substantially opposite to the first attachment member, an electric motor coupled to the input of a reduction gearing, a reel component coupled to the output of the reduction gearing, and a flexible elongated traction member connected to the reel component for winding and unwinding the traction member for raising and lowering a person. Further, the invention relates to the use of a winch according to the invention as a ceiling lift. The invention also relates to a ceiling lift assembly, comprising an overhead rail with at least one carriage guided therein, the carriage being provided with an attachment member, a winch provided with at least one attachment member on the winch housing and the winch comprising a flexible elongated traction member with an attachment member on its free end and a spreader bar with an attachment member.

BACKGROUND ART

U.S. Pat. No. 6,085,368 discloses a winch of the above type, that is used as a ceiling lift. Ceiling lifts have the advantage with respect to floor lifts with a mast and a lifting arm arrangement that they do not occupy any floor space. In certain rooms the ceiling lift may only be used on relatively few occasions, and it would be inefficient to keep a winch in such a room continually. Installing winches in a room only for periods of time when they are in use is not an attractive alternative because disengaging conventional hoists from a rail in a first room and engaging the hoist to a rail in another room is a cumbersome process, that often requires the use of special tools.

The rails for ceiling lifts are normally not continuous from one room to another. Moving a lifted person from between rooms that are not joined by a rail, e.g. through a door opening is very complicated or impossible with most conventional hoists. Conventional winches can usually only be operated in one orientation, i.e. the winch can either only be used in the "overhead" orientation where the winch housing is directly suspended from the rail with the spreader bar or other application suspended from the end of the extendable strap or cable, or the winch can only be used in the "upside down" orientation with the winch suspended from the rail via the extendable strap or cable whose free end is connected to the rail and the spreader bar is suspended from the winch housing. The optimum working position and orientation of the winch depends however on circumstances and none of the available prior art winches is flexible in this respect.

DISCLOSURE OF THE INVENTION

Against this background, it is an object of the present invention to provide a winch of the kind referred to initially, which overcomes or at least reduces the above mentioned problems by allowing it to operate in a plurality of orientations. This object is achieved in accordance with claim 1 by providing a winch of said kind with the housing having a second opening so that the traction member can be guided through the first opening or through the second opening.

Thus, it becomes possible to operate the winch in more orientations.

The second opening can be formed in a face of the housing that is substantially at right angles with the face of the housing in which the first opening is formed.

Thus, it becomes possible to operate the winch in four distinct orientations, namely:

- in the overhead orientation with the first attachment member connected to the rail, the traction member guided through the first opening in the housing and the free end of the traction member being connected to the load,
- in the upside down orientation with the first attachment member connected to the load, the traction member guided through the first opening in the housing and the free end of the traction member being connected to the rail,
- in the overhead orientation with the second attachment member connected to the rail, the traction member guided through the second opening in the housing and the free end of the traction member being connected to the load,
- in the upside down orientation with the second attachment member connected to the load, the traction member guided through the second opening in the housing and the free end of the traction member being connected to the rail.

The winch may comprise a second attachment member positioned substantially opposite to the second opening.

The first and/or second attachment member may form part of a quick release coupling system, preferably a system of the bayonet type.

The traction member may pass over a spring biased excenter shaft operatively connected with a switch that changes state when the load on the traction member exceeds a given threshold and thereby urges the excenter shaft to rotate against the spring bias.

It is another object of the present invention to provide a winch of the kind referred to initially, which is more flexible in use. This object is achieved in accordance with claim 6 by providing a winch of said kind in which the one or more attachment members form part of a quick release fastening system, preferably a system of the bayonet type.

Thus, the winch can be connected conveniently to rails, spreader bars, lifting straps and other suspension members.

Preferably, the one or more attachment members are provided with an electronic safety switch that is activated when a complementary part of the quick release fastening system is properly engaged with the attachment member concerned.

The free end of the traction member preferably comprises an attachment member, and the winch preferably comprises two attachment members.

It is another object of the present invention to provide a ceiling lift assembly of the kind referred to that is more flexible in use. This object is achieved in accordance with claim 9 by providing a winch assembly of said kind in which the attachment members are part of an interchangeably quick release coupling system. Thus the complete ceiling lift assembly can be quickly assembled and disassembled to move location, or to change operating position and orientation as different circumstances may require.

It is yet another object of the present invention to provide a winch of the kind referred to initially, with an improved mechanism for preventing operation of the electric motor when the traction member is not tensioned by a load. This object is achieved in accordance with claim 13 by providing a winch of said kind in which the traction member passes over a spring biased excenter shaft operatively connected with a switch that changes state when the load on the traction member exceeds a given threshold and thereby urges the excenter shaft to rotate against the spring bias.

The excenter shaft is preferably provided with an arm extending substantially perpendicular to the excenter shaft with the free end of the arm acting on the switch.

Further objects, features, advantages and properties of the mobile winch and use of the winch according to the invention will become apparent from the detailed description.

BRIEF DESCRIPTION OF THE DRAWINGS

In the following detailed portion of the present description, the invention will be explained in more detail with reference to the exemplary embodiments shown in the drawings, in which.

DETAILED DESCRIPTION

Figure 1:
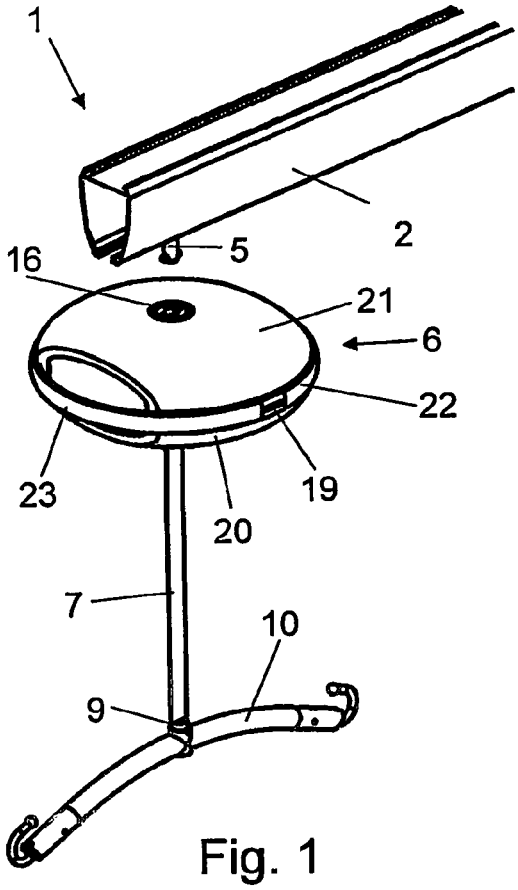
FIG. 1 is a perspective view of a winch according to the invention just before attaching it to an overhead rail.

A ceiling lift 1 according to a preferred embodiment of the invention is illustrated in FIG. 1. The ceiling lift 1 incorporates an overhead rail 2 that is mounted adjacent to the ceiling. The rail 2 can be mounted on a lift structure or alternatively be mounted to the ceiling. A carriage (not shown) with a downward projection 5 is guided in the overhead rail 2.

A discus shaped winch 6 is ready to be attached to the downward projection 5 at a connection point formed by first female seat 16. The first female seat 16 and the downward projection 5 form a quick coupling of the bayonet type that will be described in more detail further below.

The housing of the winch 6 is formed by a first convex side panel 20 and a second convex side panel 21 that are interconnected by a rim 22. Two recesses in the winch housing allow two diametrically opposite parts of the circumference of the rim 22 serve as handles 23.

A lifting strap 7 projects from a first opening 17 (FIG. 5) in the first convex side panel 20. A second opening 19 through which the strap 7 can leave the housing is provided in the rim 22. The free end 9 of the lifting strap 7 is attached to a spreader bar 10. The extremities of the spreader bar 10 are provided with hooks for attaching a sling or the like (not shown) holding the patient to be lifted.

Figure 2:
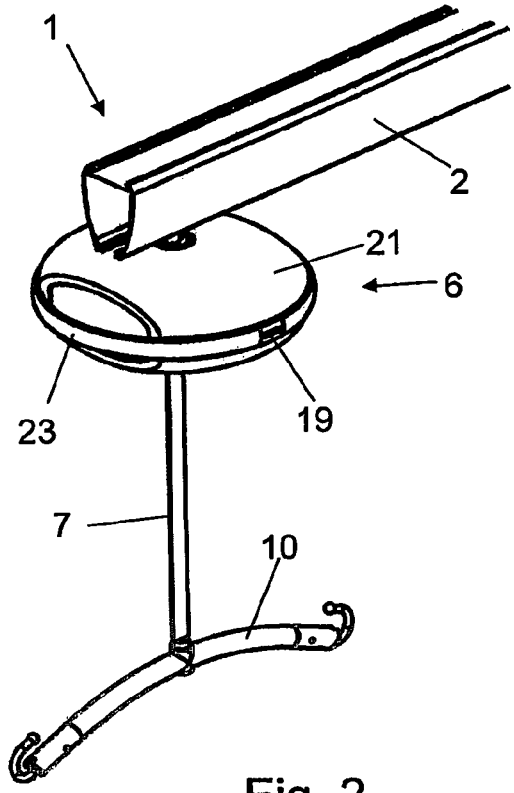
FIG. 2 is a perspective view of a winch according to the invention while attaching it to an overhead rail.
Figure 3:
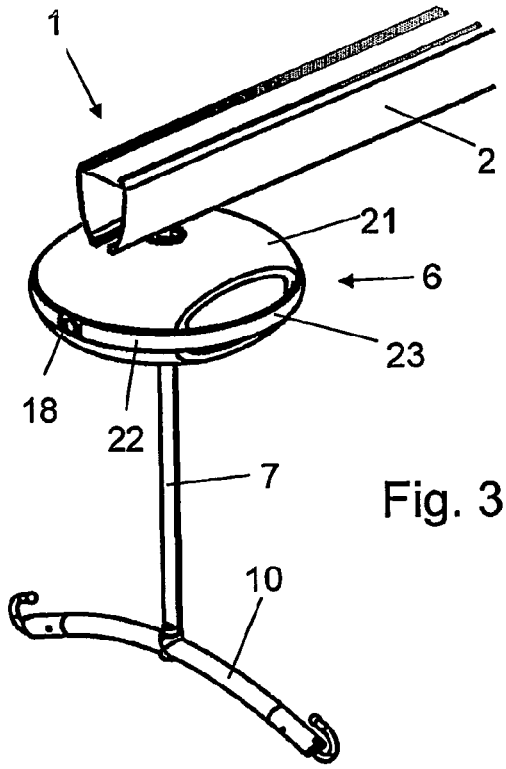
FIG. 3 is a perspective view of a winch according to the invention when it is securely attached an overhead rail.

FIG. 2 shows the winch 6 with the first female seat 16 placed over the downward projection 5. FIG. 3 shows the winch secured by rotating it 90° relative to the orientation in FIG. 2 about the vertical axis to engage the bayonet coupling. A second female seat 18, disposed diametrically opposite to the second opening 19 can now be seen. The operating position of the winch 6 to the carriage in the rail as in FIGS. 1 to 3 will in the following be referred to as "overhead mounted".

Figure 4:
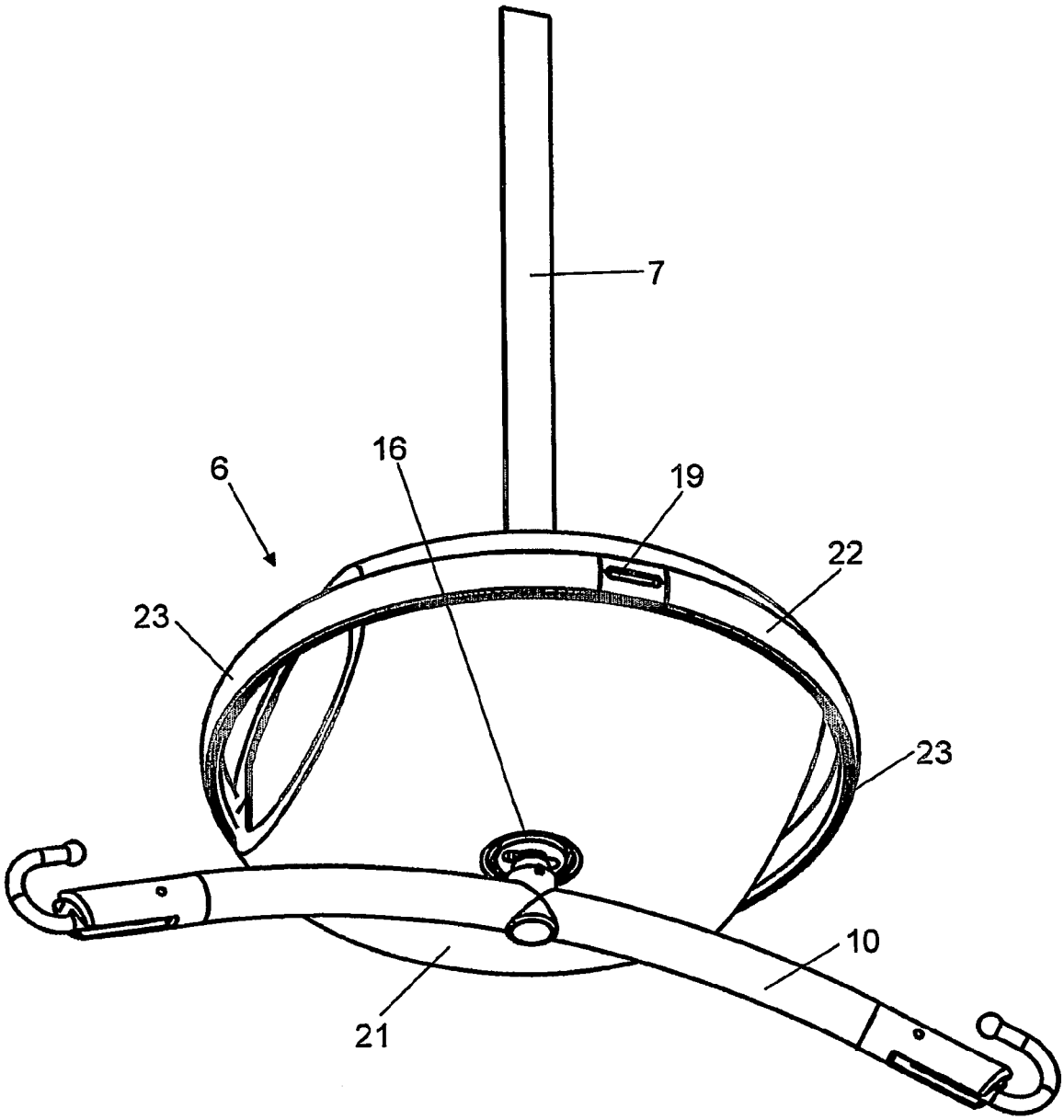
FIG. 4 is a detailed perspective view from below on an upside down mounted winch according to the invention with a spreader bar directly attached to it.

FIG. 4 shows the winch 6 from below. The free end of the strap 7 is connected to the projection 5 of the carriage in the rail 2. The winch 6 is thus suspended from the strap 7. The spreader bar 10 is directly connected to the winch 6 at the first female seat 16. The operating position of the winch as in FIG. 4 will in the following be referred to as "upside down mounted".

Figure 5:
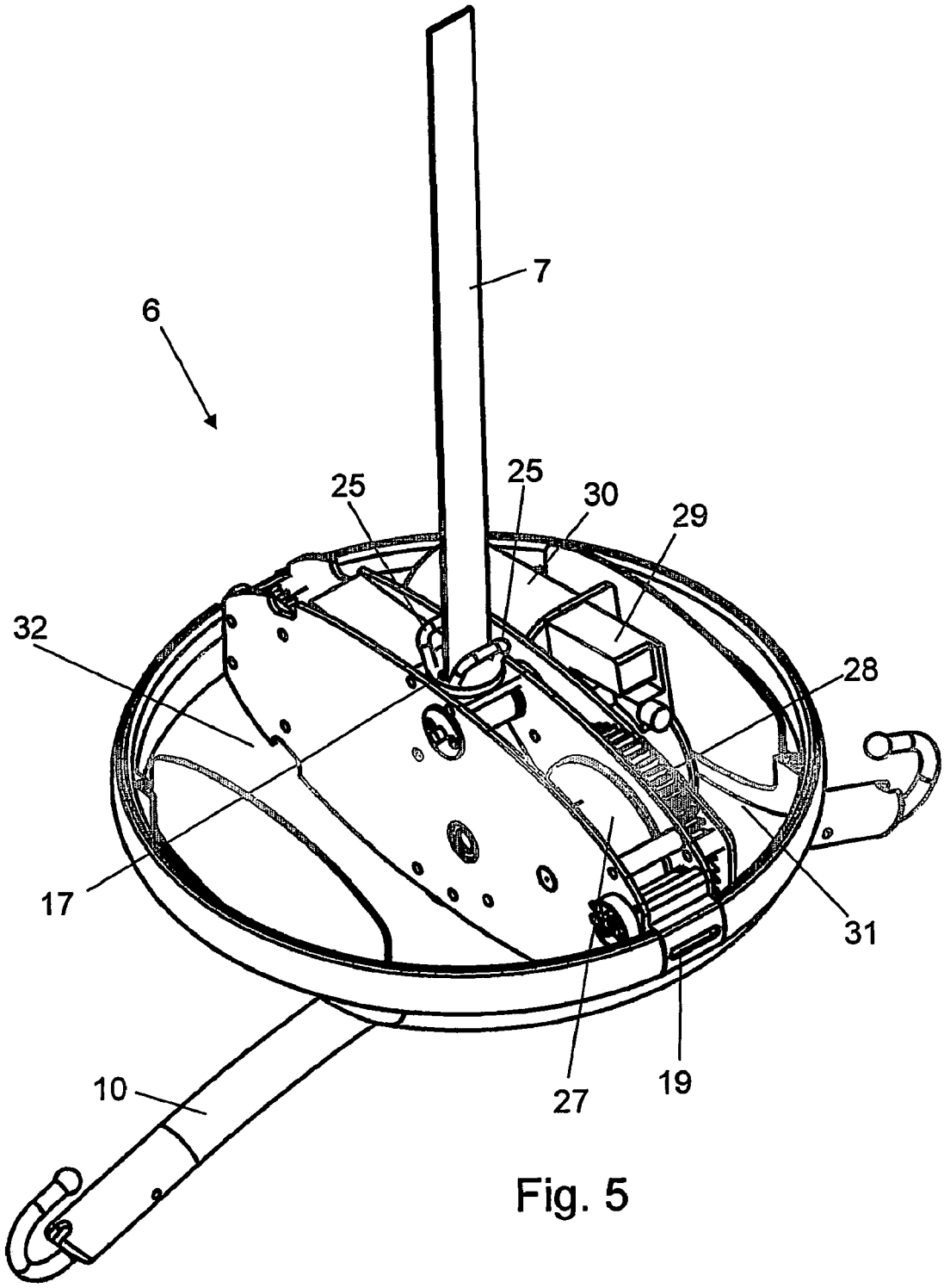
FIG. 5 is a detailed perspective cut-open view from above of an upside down mounted winch of FIG. 5.
Figure 9:
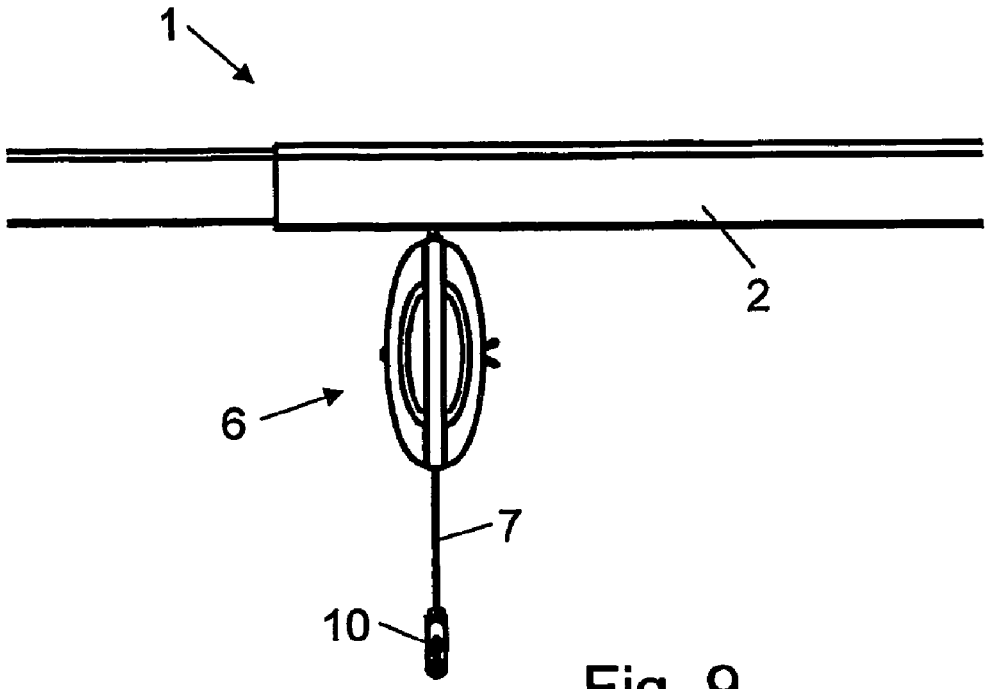
FIG. 9 is a view of a ceiling lift according to the invention with an upside down mounted winch in a vertical orientation.
Figure 10:
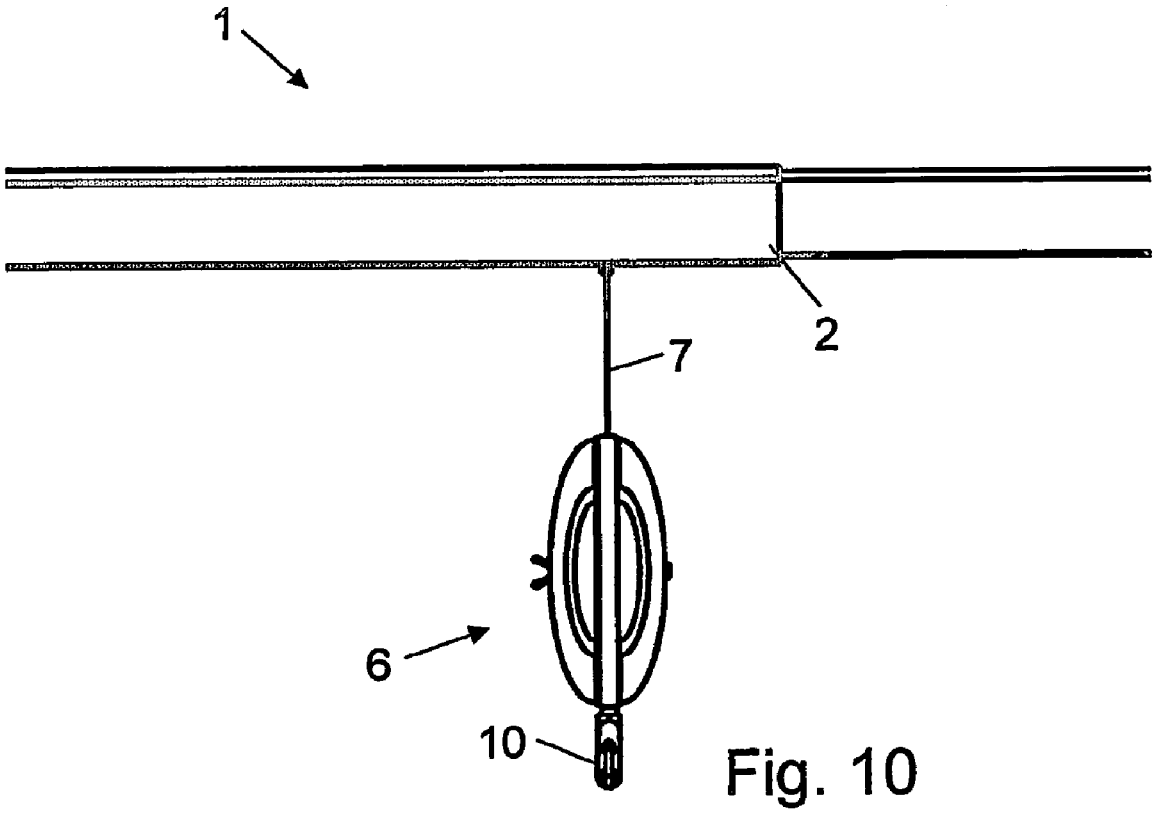
FIG. 10 is a view of a ceiling lift according to the invention with an upside down mounted winch in a vertical orientation.

FIG. 5 shows the winch 6 from above with the first convex side panel 20 removed. The strap 7 is guided through the first opening 17 which is provided with a lug 25 on each side. Inside the housing the winch 6 is provided with a support structure with two parallel transverse plates 26. A reel 27 for winding and unwinding the strap 7 is rotatably engaged between the transverse plates 26. The reel 27 is connected to the output of a straight reduction gearing 28 which is in turn connected to the output of a worm drive 29. The worm drive 29 is driven by a battery powered electric motor 30. The electric motor 30, the worm gear 29 and the reduction gearing 28 are arranged in a compartment 31 next to the support structure. The batteries (not shown) are received in a compartment 32 on the opposite side of the support structure, thus giving the winch 6 a substantially equal weight distribution. The strap 7 can be completely rolled up onto the reel and paid out through the second opening 19, so that the winch may be used in another orientation. When the strap 7 extends though the first opening 17 the winch can be used in the "horizontal" position as illustrated in FIGS. 1 to 7. When the strap 7 extends though the second opening 19 the winch 6 can be used in the "vertical" position as illustrated in FIGS. 9 and 10. Each of these orientations has its advantages, and the optimum choice of operating position depends on circumstances.

Figure 6:
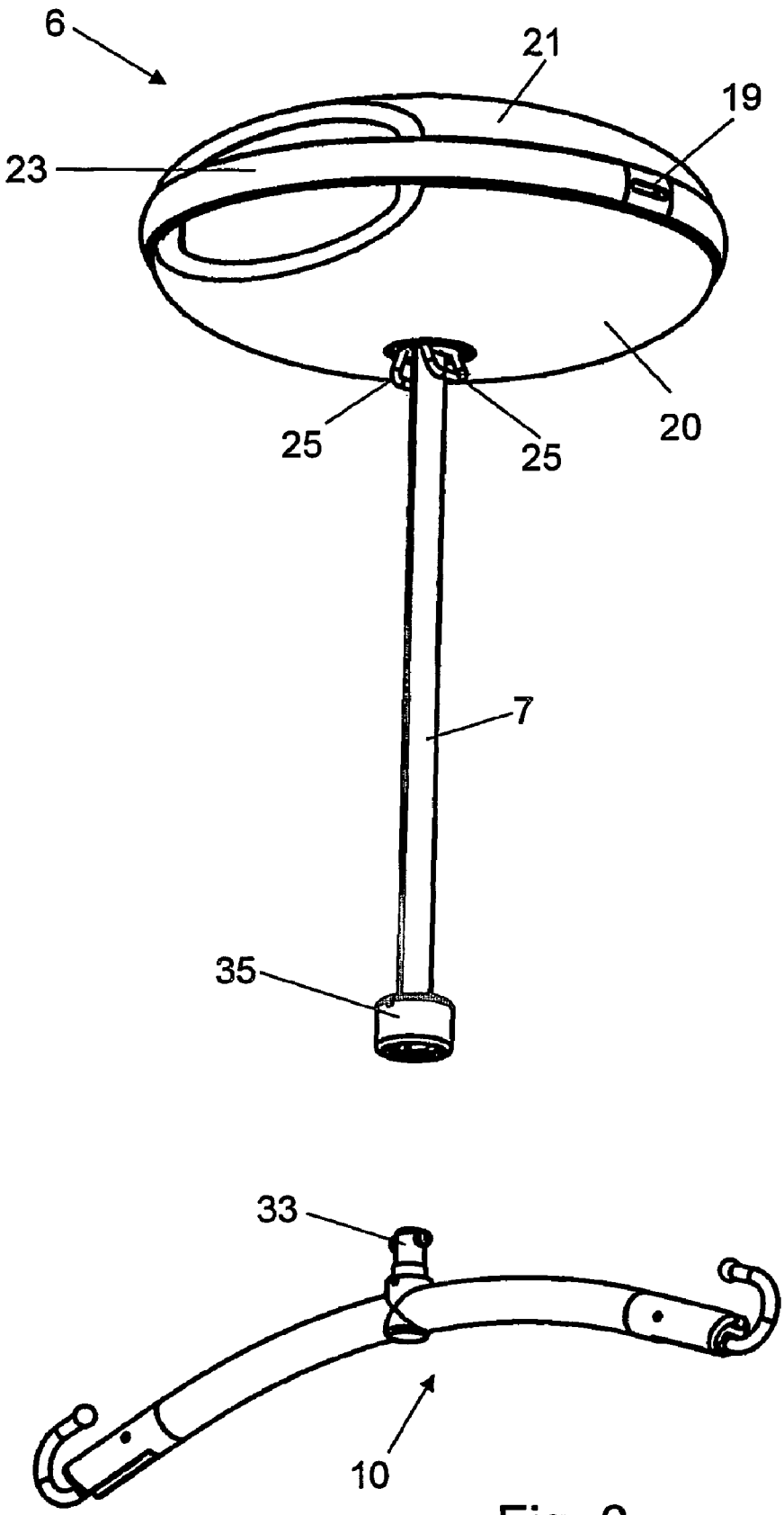
FIG. 6 is a view of a spreader bar and a free end of a strap with a quick coupling system according to the invention.

FIG. 6 shows a detail of the quick coupling system of the spreader bar 10 and the free end 9 of the strap 7. A male part 33 the bayonet type quick coupling system extends upward from the spreader bar 10. The free end 9 of the strap is provided with a seat 35 that incorporates the female part of the bayonet type quick coupling system. Connecting the spreader bar 10 to the free end 9 of the strap 7 is thus merely a matter of inserting the male part 33 into the female seat 35 and turning the seat 35 and the spreader bar 90° relative to one another. The quick coupling system is interchangeable throughout the ceiling lift, i.e. the male parts 5 and 33 fit to all female seats 16, 18 and 35.

Figure 7:
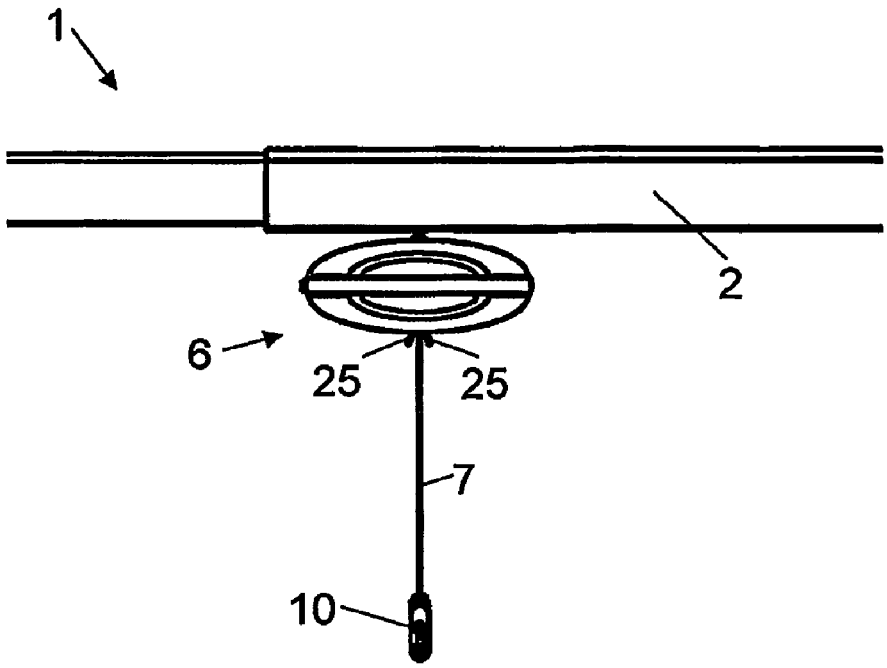
FIG. 7 is a view of a ceiling lift according to the invention with an overhead mounted winch in a horizontal orientation.

FIGS. 7 to 10 show the ceiling lift 1 in different operating positions and orientations. In FIG. 7 the winch 6 is overhead mounted and the housing is in the horizontal orientation. This operating position gives a high maximum lifting height and the winch 6 itself is always far from the head of the patient. The winch 6 has however to be lifted up to the ceiling for mounting it with the first female seat 16 to the projection 5 of the carriage in the rail 2.

Figure 8:
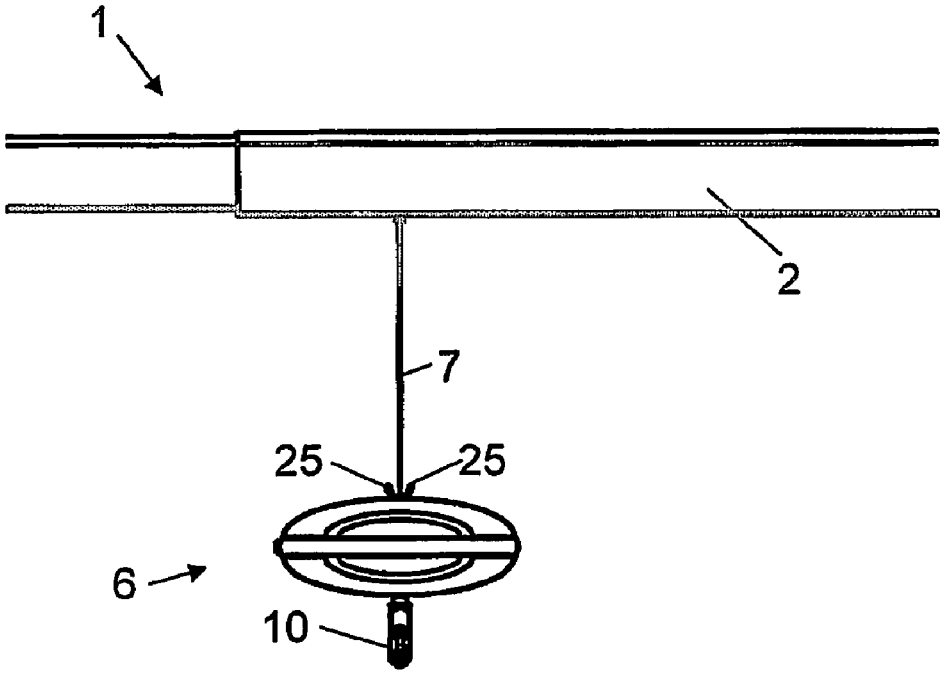
FIG. 8 is a view of a ceiling lift according to the invention with an overhead mounted winch in a horizontal orientation.

In FIG. 8 the winch 6 is mounted upside down and the housing is in the horizontal orientation. This operating position gives also a high maximum lifting height. The winch 6 can be mounted to the rail 2 by extending the strap 7 and engaging the female seat 35 on the free end 9 of the strap to the projection 5 of the carriage in the rail 2. Then the winch 6 is activated to wind the strap 7 to lift the winch with the spreader bar 10 attached thereto. In this operating position the winch 6 itself is however always close to the head of the patient which could be experienced as an inconvenience. This operating position is particularly suitable for transfer between rooms that are not joined by a rail, as will be set out in detail below In FIG. 9 the winch 6 is overhead mounted and the housing is in a vertical orientation. This operating position gives a somewhat reduced maximum lifting height but the winch 6 itself is always far from the head of the patient. The winch 6 has however to be lifted up to the ceiling for mounting it with the first female seat 16 to the projection 5 of the carriage in the rail 2.

In FIG. 10 the winch 6 is upside down mounted and the housing is in a vertical orientation. This operating position gives a somewhat reduced maximum lifting height. The winch 6 can be mounted to the rail 2 by extending the strap 7 and engaging the female seat 35 on the free end 9 of the strap to the projection 5 of the carriage in the rail 2. Then the winch 6 is activated to wind the strap 7 to lift the winch with the spreader bar 10 attached thereto. In this operating position the winch itself is always near to the head of the patient but since it extends mainly vertically this is usually not experienced as an inconvenience.

Figure 11:
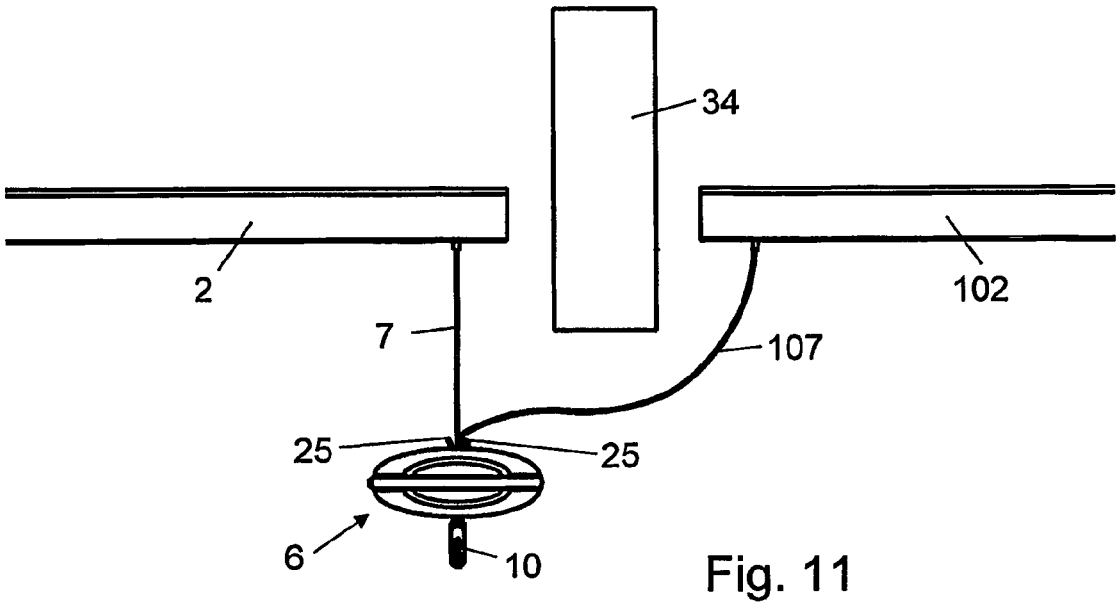
FIGS. 11 to 14 illustrate step by step the procedure of passing though a door opening with the winch assembly according to the invention where the rail is interrupted.
Figure 12:
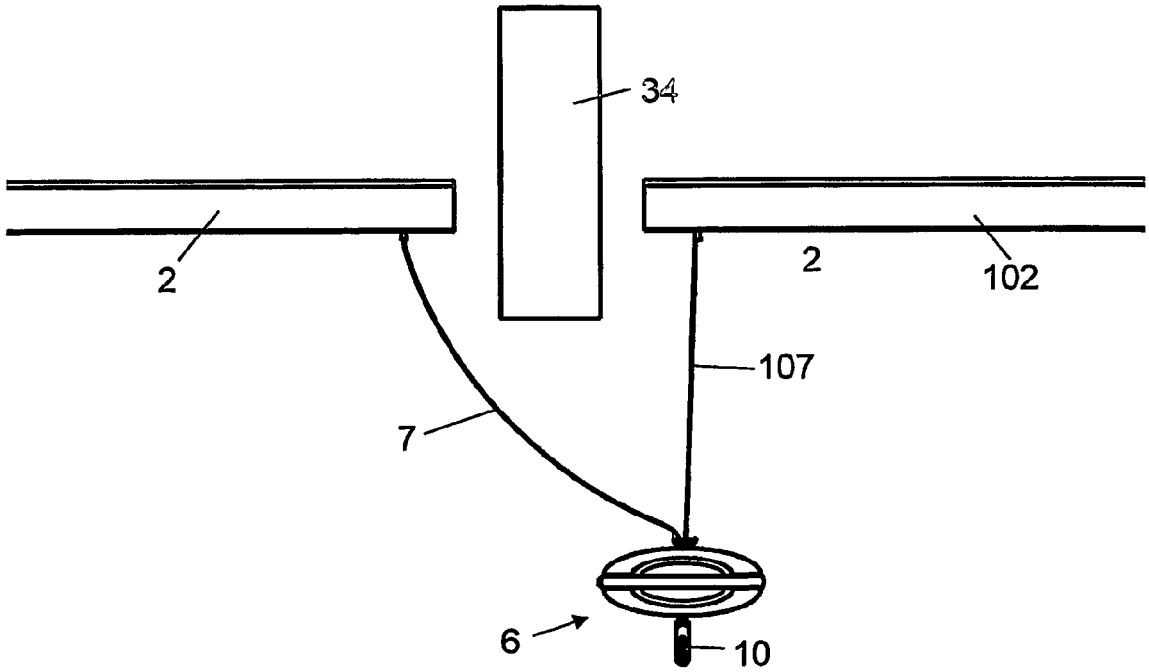
Figure 13:
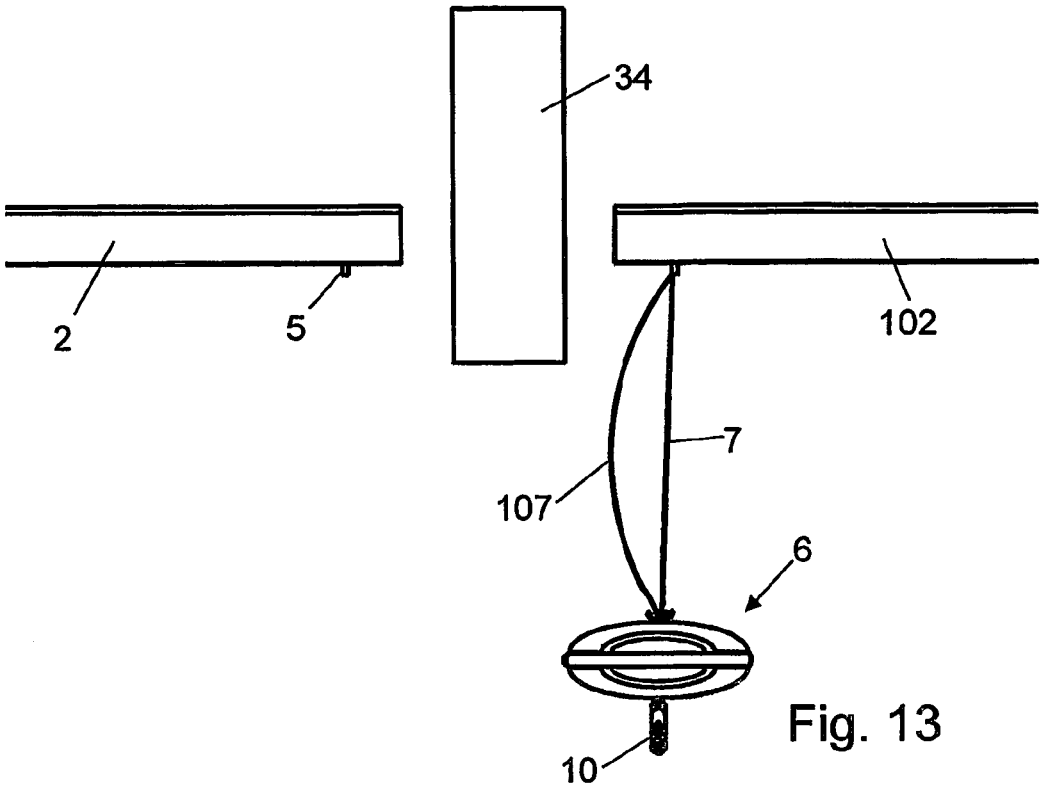
Figure 14:
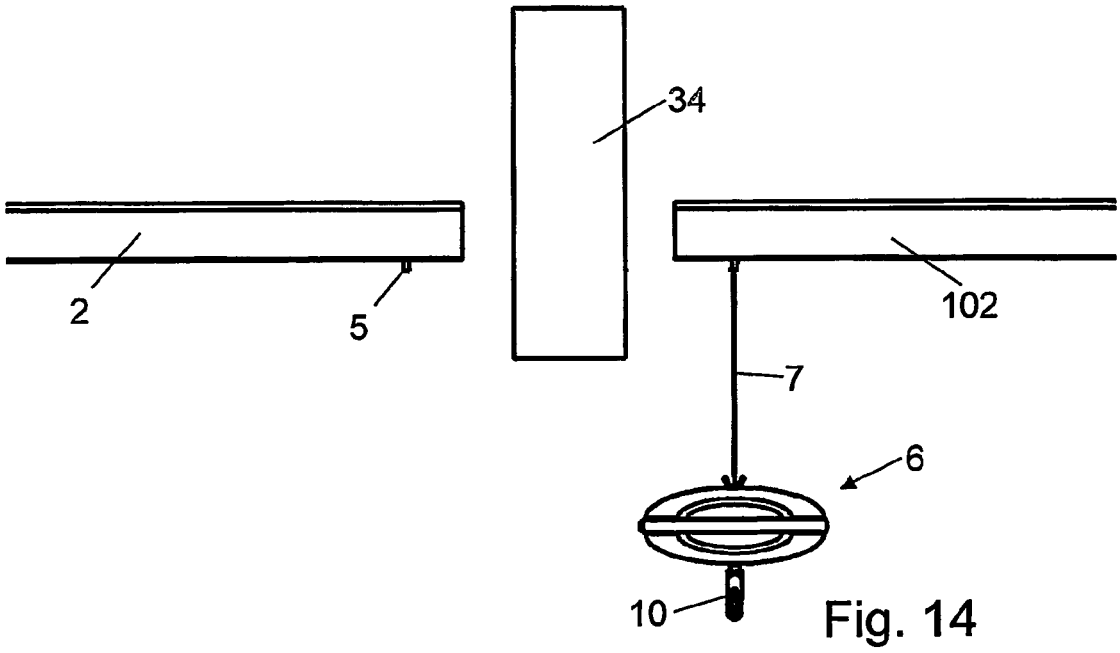

FIGS. 11 to 14 illustrate step by step the procedure of passing though a door opening. The lift is to be transferred from the rail 2 to a second rail 102 in an adjacent room. In FIG. 11 the operating position at the start of the procedure is the same as in FIG. 8. The free end 9 of the strap 7 is attached to the carriage in the rail 2 left to the wall 34 separating the two adjacent rooms. The door opening through which the lift with or without a patient should pass is below the wall 34. A second non-windable strap 107 has one of its ends hooked to one of the a lugs 25, and its other end connected to a carriage in the rail 102. In the next step (FIG. 12) the strap 7 is carefully unwound and the load gradually transfers to strap 107. Next (FIG. 13), the free end 9 of the strap 7 is detached from the carriage in rail 2 and reconnected to a carriage in rail 102. Then, strap 7 is wound until the load transfers back to it and when the strap 107 is no longer carrying any load it is removed (FIG. 14) and the procedure is complete. The procedure is facilitated by the use of the quick coupling system.

Figure 15:
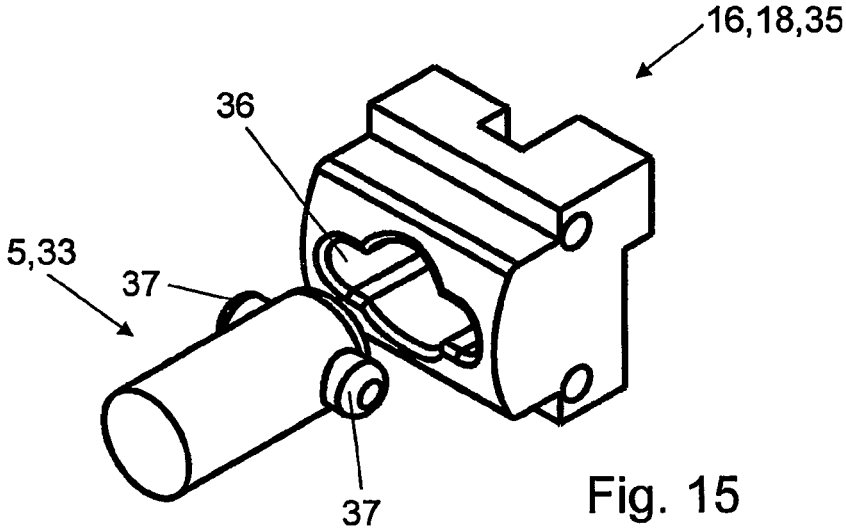
FIG. 15 is a detailed view of the bayonet type quick coupling of the winch and ceiling lift according to the invention.
Figure 16:
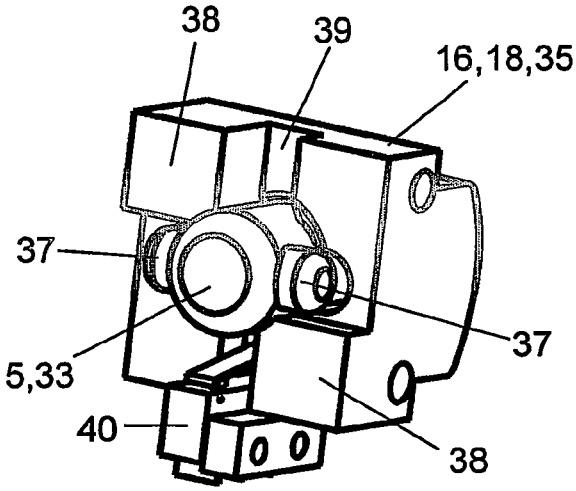
FIGS. 16 and 17 illustrate the engagement procedure of the quick coupling.
Figure 17:
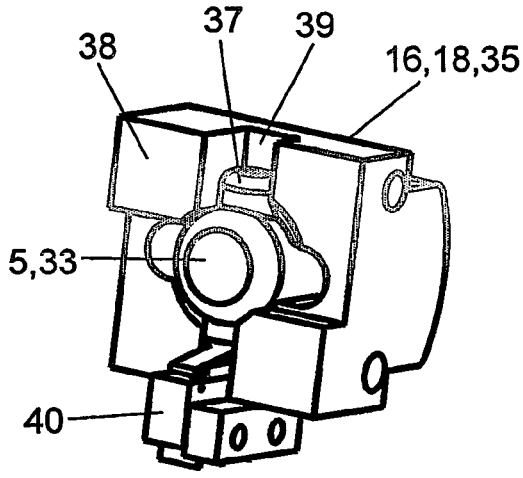

FIGS. 15 to 17 illustrate in detail the bayonet type quick coupling system according to a preferred embodiment of the invention and its operation. In FIG. 15 the male part 5,34 provided with two diametrically opposite redial protrusions 37 is placed just in front of the female seat 16,18,35 for insertion. The female seat 16,18,35 is provided with a slot 36 suited for receiving the male part 5,33 in the orientation shown. To engage the coupling, the male part 5,33 is fully inserted into the slot 36 (FIG. 16) and turned 90° relative to the female seat 16,18,35 (FIG. 17) and then released. The female seat is provided with two abutment blocks 38 that allow rotation in only one direction when the male part 5,34 has just been inserted into the slot 36. A notch 39 in the female seat for receiving the protrusions 37 extends to both sides of the slot 36. The protrusions 37 are securely locked into the notch 39 when a load is applied to the male part 5, 34. In order to further improve safety, a micro switch 40 is arranged partially in the notch 39 such that it changes state when the protrusions 37 engage properly into the notch 39. The micro switch 40 is connected to an electronic control unit 60 (FIG. 18) that controls operation of the electric motor 30. When the switch is not actuated by a protrusion 37 the control unit prevents any winding or unwinding for safety reasons.

Figure 18:
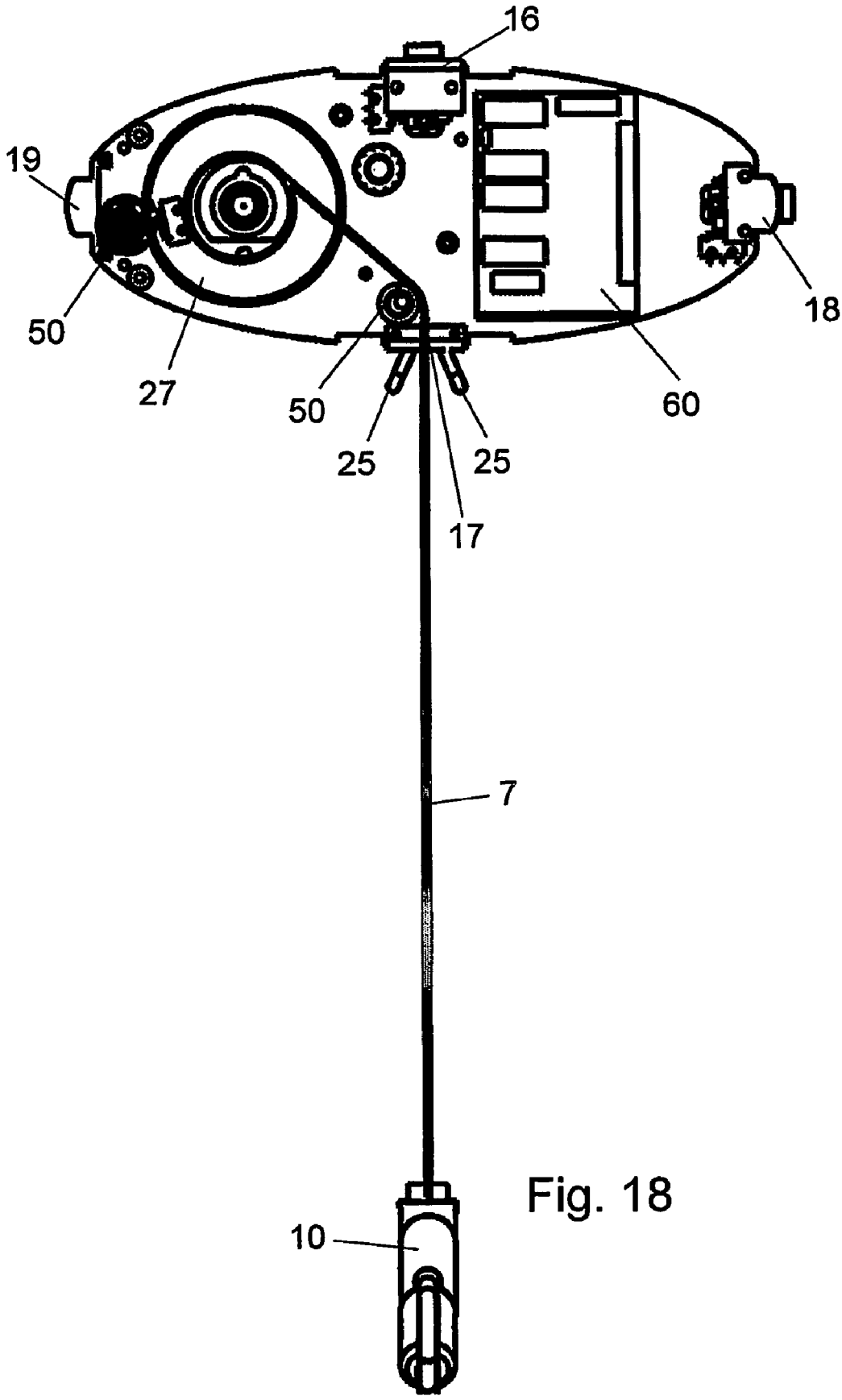
FIG. 18 is a view of a load detection system according to the invention.
Figure 19:
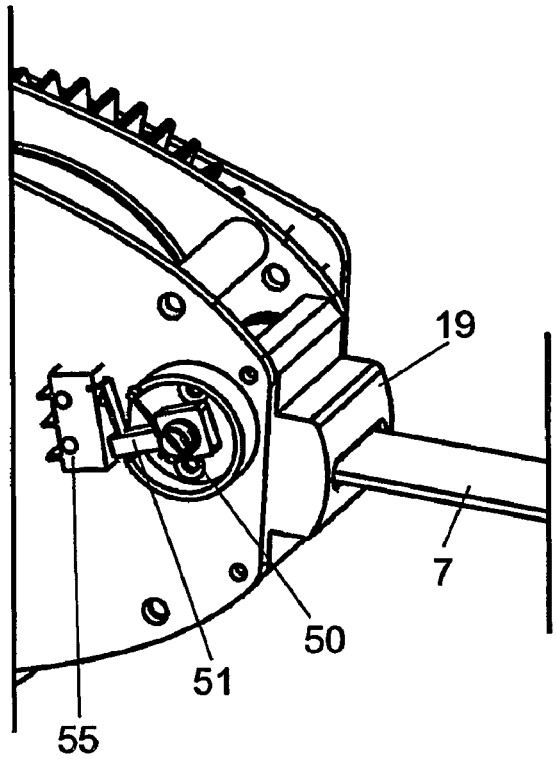
FIGS. 19 and 20 are detailed views of the load detection system.
Figure 20:
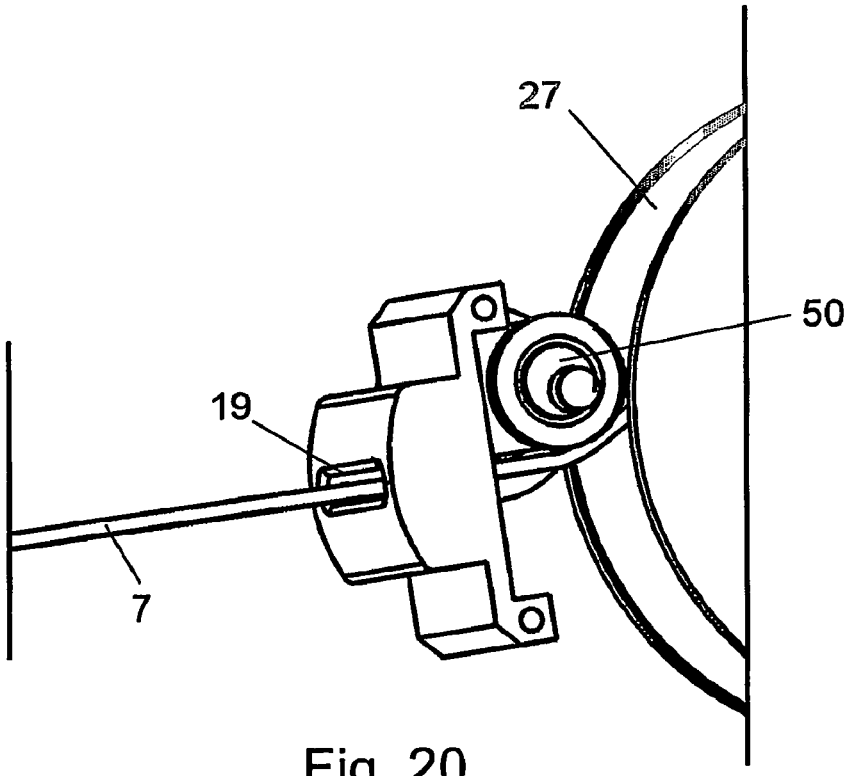

FIGS. 18 to 20 show the details of the system in the winch 6 that prevents inadvertently winding or unwinding of the strap 7 when there is no load on the strap 7. FIG. 18 shows a cut open side view on the interior of the winch. The strap 7 extends from the reel 27, passes over an excenter shaft 50 and leaves the winch 6 through the first opening 17. The excenter shaft 50 is spring biased and provided with a radially extending arm 51 that actuates a micro switch 55. Tension in the strap 7 urges the excenter shaft 50 to rotate against the spring bias and the radial arm rotates in unison with the excenter shaft. Thus, the switch changes state when a load above a preset threshold is applied to the strap 7. The micro switch 55 is connected to the electronic control unit 60. The electronic control unit 60 prevents winding and unwinding of the strap when no load on the strap 7 can be detected. Thus, inadvertently winding or unwinding an unloaded strap is avoided. The winch 6 is also provided with an excenter shaft 50, radial arm 51 and micro switch 55 at the second opening 19 from which the strap can leave the winch (FIG. 19,20).

Although the present invention has been described in detail for purpose of illustration, it is understood that such detail is solely for that purpose, and variations can be made therein by those skilled in the art without departing from the scope of the invention.

Thus, while the preferred embodiments of the devices and methods have been described in reference to the environment in which they were developed, they are merely illustrative of the principles of the inventions. Other embodiments and configurations may be devised without departing from the scope of the appended claims.

The invention claimed is:

1. A winch (6) for raising and lowering persons, comprising:

a housing provided with a first attachment member (16), a first opening (17) in the housing substantially opposite to the first attachment member, an electric motor (30) coupled to the input of a reduction gearing (28,29), a reel component (27) coupled to the output of the reduction gearing (28,29), a flexible elongated traction member (7) connected to the reel component for winding and unwinding the traction (7) member for raising and lowering a person, characterized in that the housing is provided with a second opening (19) and the traction member (7) being guided through the first opening (17) or through the second opening (19);

wherein the second opening is configured for guiding the traction member and the reel is disposed relative to the first and second opening such that the traction member can be run through either the first opening or the second opening while being rolled up onto the reel and paid out from the reel.

2. A winch according to claim 1, characterized in that the second opening (19) is formed in a face of the housing that is substantially at right angles with the face of the housing in which the first opening (17) is formed.

3. A winch according to claim 1, characterized by comprising a second attachment member (18) positioned substantially opposite to the second opening (19).

4. A winch according to claim 1, characterized in that the first or second attachment member (16,18) form part of a quick release fastening system.

5. A winch according to claim 1, characterized in that the traction member (7) passes over a spring biased excenter shaft (51) operatively connected with a switch (55) that changes state when the load on the traction member (7) exceeds a given threshold and thereby urges the excenter shaft to rotate against the spring bias.

6. A winch (6) for raising and lowering persons, comprising:

a housing provided with a plurality of attachment members (16,18,35), a first opening (17) in the housing substantially opposite to one of said attachment members, an electric motor (30) coupled to the input of a reduction gearing (28,29), a reel component (27) coupled to the output of the reduction gearing (28,29), a flexible elongated traction member (7) connected to the reel component for winding and unwinding the traction (7) member for raising and lowering a person, wherein the plurality of attachment members (16,18,35) form part of a quick release fastening system.

7. A winch according to claim 6, characterized in that the one or more attachment members (16,18,35) are provided with an electronic safety switch (40) that changes state when a complementary part (5,33) of the quick release fastening system is properly engaged with the attachment member (16, 18,35) concerned.

8. A winch according to claim 6, characterized in that the free end of the traction member (7) comprises an attachment member (35), and the winch comprises two attachment members (16,18).

9. A ceiling lift assembly (1), comprising an overhead rail (2) with at least one carriage guided therein, the carriage being provided with an attachment member (5), a winch (6) provided with at least one attachment member (16,18) on a winch housing and the winch (6) comprising a flexible elongated traction member (7) with an attachment member (35) on its free end (9) and a spreader bar (10) with an attachment member (33), characterized in that the attachment members (5,16,18,33,35) are part of an interchangeably quick release coupling system.

10. A ceiling lift assembly according to claim 9, characterized in that the quick release coupling system comprises male attachment members and female attachment members, and whereby the attachment member (5) on the carriage and the attachment member (33) on the spreader bar are of the same type, and whereby the attachment members (16,18) on the housing as well as the attachment member (35) on the free end of the traction member are complementary to the attachment member (5) on the carriage and the attachment member (33) on the spreader bar (10).

11. A ceiling lift assembly according to claim 9, characterized in that the quick coupling system comprises a safety switch (40) that changes state when a coupling is properly engaged.

12. A ceiling lift assembly according to claim 9, characterized in that the quick coupling system is of the bayonet type that cannot be released under load.

13. A winch for raising and lowering persons, comprising:

a housing provided with an attachment member (16), an opening (17) formed in the housing substantially opposite to the attachment member, an electric motor (30) coupled to the input of a reduction gearing (28,29), a reel component (27) coupled to the output of the reduction gearing (28,29), a flexible elongated traction member (7) connected to the reel component (27) for winding and unwinding the traction member (7) for raising and lowering a person with the traction member (7) being guided through the opening (17), characterized in that the traction member (7) passes over a spring biased excenter shaft (50) operatively connected with a switch (55) that changes state when the load on the traction member (7) exceeds a given threshold and thereby urges the excenter shaft (50) to rotate against the spring bias.

14. A winch according to claim 13, characterized in that the excenter shaft (50) is provided with an arm (51) extending substantially perpendicular from the excenter shaft (50) with the free end of the arm (51) acting on the switch (55).

* * * * *